US005199237A

United States Patent [19]

Juntunen

[11] Patent Number: 5,199,237

[45] Date of Patent: Apr. 6, 1993

[54] MITERLESS MOLDING SYSTEM

[75] Inventor: William H. Juntunen, Middlebury, Ind.

[73] Assignee: Abitibi-Price Corporation, Troy, Mich.

[21] Appl. No.: 816,347

[22] Filed: Dec. 30, 1991

[51] Int. Cl.[5] ..... E04B 5/00

[52] U.S. Cl. ..... 52/288; 52/287

[58] Field of Search ..... 52/288, 287, 211, 408

[56] References Cited

U.S. PATENT DOCUMENTS

| | | | |
|---|---|---|---|
| 323,110 | 7/1885 | Carlewitz | 52/288 |
| 2,069,289 | 2/1937 | Swendsen et al. | 52/288 |
| 2,307,338 | 1/1943 | Sluyter et al. | 52/288 |
| 2,915,794 | 12/1959 | Hillmann | 52/288 |
| 3,481,092 | 12/1969 | Constantino | 52/288 |
| 3,707,061 | 12/1972 | Collette et al. | 52/288 |
| 5,001,877 | 3/1991 | Edwards | 52/288 |

FOREIGN PATENT DOCUMENTS

| | | | |
|---|---|---|---|
| 1186222 | 4/1970 | United Kingdom | 52/288 |
| 1421484 | 1/1976 | United Kingdom | 52/287 |
| 2191518 | 12/1987 | United Kingdom | 52/288 |

*Primary Examiner*—Carl D. Friedman
*Assistant Examiner*—Joanne C. Downs
*Attorney, Agent, or Firm*—Barnes, Kisselle, Raisch, Choate, Whittemore & Hulbert

[57] ABSTRACT

A decorative receptacle covering and providing the appearance of a finished joint between the adjacent rough cut ends of two lineal moldings. The receptacle slidably receives the ends of the lineal moldings, covers the ends and allows cutting the moldings to a rough length and rough end cut, thereby reducing or eliminating the need for precision carpentry skills by one installing the moldings. Receptacles can be made for a wide variety of decorative moldings including casing moldings, base moldings, chair rail moldings, and crown moldings.

12 Claims, 4 Drawing Sheets

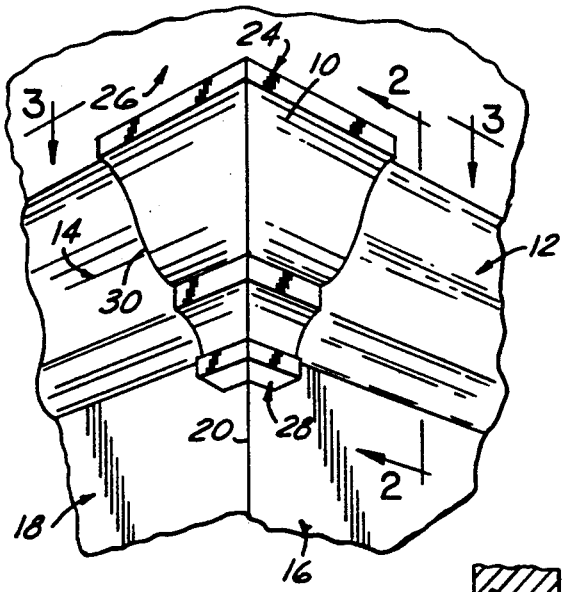
FIG. 1
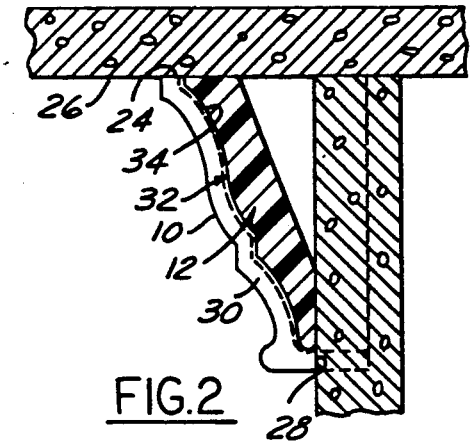
FIG. 2
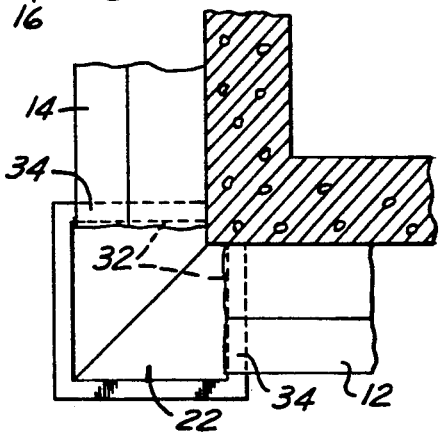
FIG. 3
FIG. 4
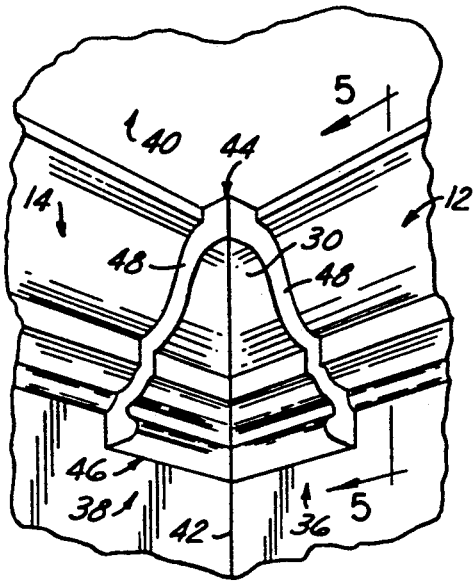
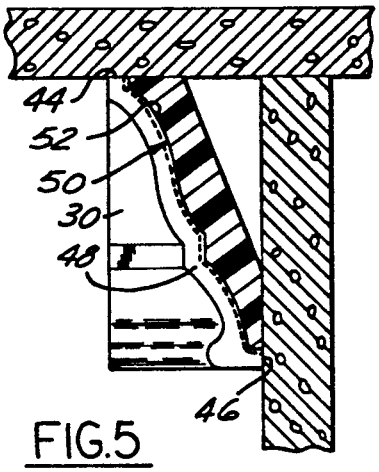
FIG. 5

MITERLESS MOLDING SYSTEM

FIELD OF THE INVENTION

This invention relates to decorative moldings and more particularly to receptacles for forming joints between adjacent decorative wall moldings.

BACKGROUND

Decorative wall moldings made from lineal segments of wood or plastic are commonly used to form base, chair rail, and ceiling moldings around the perimeter of a room, as well as casing moldings around windows and entranceways. The lineal segments are precisely cut to form mitered joints at the corners formed between two segments, a technique requiring measurement and cutting skills possessed by one skilled in the finish carpentry trade. Alternatively, the lineal segments are cut to precise lengths with accurate right angle cuts, and the ends are then abutted with separate blocks which form the corner pieces. This technique still requires finish carpentry skills to cut precise lengths and accurate right angles, but eliminates the skill required to produce precise mitered joints.

SUMMARY

Pursuant to this invention, adjacent ends of adjacent lineal moldings are brought into approximate engaging communication and a receptacle is accurately engaged over the adjacent ends of the lineal moldings, thereby providing the appearance of an accurate and precise joint between the adjacent moldings while requiring minimal carpentry skills to rough cut the moldings to approximately the correct length. During assembly, rough cut decorative wall moldings need be only approximately mated or joined at adjacent ends and then covered with a receptacle to create a clean complementary surface at the transition between adjoining moldings, and especially where the moldings meet at a corner. Thus, making a joint and particularly a right angle miter joint requires only nominal carpentry skills and simple tools.

Receptacles can be provided for both lineal joints and corner joints of adjacent lineal moldings. To provide a clean mating surface, a receptacle telescopically receives and engages with a complementary fit over the exposed decorative contoured surfaces of each molding. The receptacle overlies the joint formed between adjacent moldings, thereby allowing sizing of lineal molding segments using rough length dimensions and rough end cuts, leaving gaps of imprecise lineal and corner fit-up between moldings.

The receptacles are preferably molded from a foamed plastic, and have a relieved decorative outer surface and two sides with complementary contoured inner surfaces which matingly engage upon joining with the decorative contoured surfaces of adjacent lineal moldings. Preferably, both the lineal moldings and the receptacles are produced from a plastic which imparts a porous texture to their outer surfaces, thereby enhancing their ability to receive stain and paint.

Objects, features and advantages of this invention are to substantially decrease the level of carpentry skill and tools required to assemble and join adjacent decorative lineal moldings, reduce the time and labor required to cut, fit and install moldings, to provide miterless moldings, enable unskilled persons and do-it-yourselfers to easily install moldings, and to provide a molding system of simplified design and economical manufacture and assembly.

BRIEF DESCRIPTION OF THE DRAWINGS

These and other objects, features and advantages of this invention will be apparent from the following detailed description, appended claims and accompanying drawings in which:

FIG. 1 is a perspective view of an outside corner crown receptacle of the present invention disposed over the adjacent ends of two lineal crown moldings;

FIG. 2 is a sectional view taken along the line 2—2 of FIG. 1;

FIG. 3 is a plan view of the moldings and corner receptacle in assembly taken along the plane 3—3 of FIG. 1;

FIG. 4 is a perspective view of an inside corner crown receptacle disposed over the adjacent ends of two lineal crown moldings;

FIG. 5 is a sectional view taken along the line 5—5 of FIG. 4;

DETAILED DESCRIPTION

Figure 6:
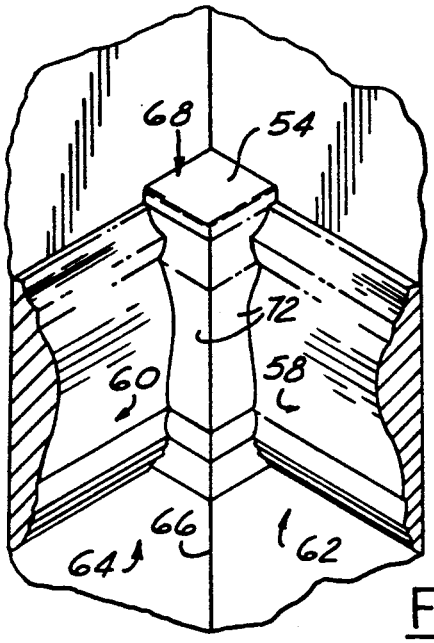
FIG. 6 is a perspective front view of an inside corner receptacle disposed over the adjacent ends of two lineal chair rail moldings.

Referring in more detail to the drawings, FIG. 1 illustrates an outside corner crown receptacle 10 of this invention receivably engaging with a complementary fit over the exposed decorative contoured surfaces of two lineal crown moldings 12 and 14 secured to walls 16 and 18 adjacent an outside corner 20. As shown in FIGS. 2 and 3, the receptacle 10 receivably engages with the exposed decorative surfaces of the lineal moldings 12 and 14 and slidably or telescopically receives the moldings. As shown in FIGS. 1 and 3, the receptacle 10 provides the exterior appearance of an accurate and precise joint even though there is a gap 22 between the adjacent ends of the two lineal molding segments 12 and 14. This permits the moldings 12 and 14 to have rough cut ends and be cut to only approximately the correct length.

The crown receptacle 10 has right angular walls with top edges 24 which bear on the ceiling or overhead wall 26, bottom edges 28 which overlap the moldings and bear on the sidewalls 16 and 18 below the moldings. Side edges 30 extend between the top and bottom edges and preferably terminate in inwardly projecting ribs 32 with an end surface 34 having a contour complementary to and bearing on the exterior surface of the moldings 12 and 14. Thus, as shown in FIG. 3, the adjacent rough cut ends of the moldings 12 and 14 are totally enclosed and hidden from view by the cooperation of the cover receptacle with the moldings and adjacent sidewalls 16 and 18 and ceiling. The ribs 32 also tend to retain within the receptacle any adhesive used to secure it to the moldings.

FIGS. 4 and 5 illustrate an inside corner crown receptacle 30 disposed over the adjacent ends of crown moldings 12 and 14 secured to sidewalls 36 and 38 bearing on a ceiling 40 and forming an inside corner 42. The receptacle 30 has right angular walls with top and bottom edges 44 and 46 which bear on the ceiling and sidewalls respectively and side edges 48 with ribs 50 which project inwardly and have an end surface 52 which is complementary to and bears on the exterior surface of the moldings. Thus, in assembly, the receptacle 30 in cooperation with the sidewalls and ceiling totally encloses and masks from view the adjacent ends of the moldings 12 and 14 to provide the exterior appearance of an accurate and precise corner joint even though the moldings have rough cut ends, do not bear on one another, and may be cut to only approximately the correct length.

Figure 7:
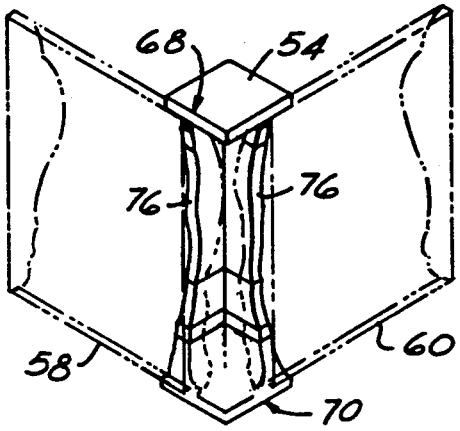
FIG. 7 is a perspective back view of the receptacle and moldings of FIG. 6 with the moldings shown in phantom lines.

FIGS. 6 and 7 illustrate an outside corner chair rail receptacle 54 disposed over the adjacent ends of chair rail moldings 58 and 60. The receptacle 54 provides the appearance of a precise joint between the adjacent chair rail moldings 58 and 60 which bear on right angle walls 62 and 64 forming an inside corner 66. The receptacle has right angular walls with top and bottom edges 68 and 70 which bear on sidewalls and side edges 72 which project inwardly and have an end surface 76 which is complementary to and bears on the exterior surface of the moldings. Thus, in assembly, the receptacle in cooperation with each wall totally encloses and masks from view the adjacent ends of the moldings 58 and 60 to provide the exterior appearance of an accurate and precise corner joint. The lineal moldings 58 and 60 are telescopically received in the receptacle and hence need not be cut to a precise length and can have rough cut ends.

Figure 8:
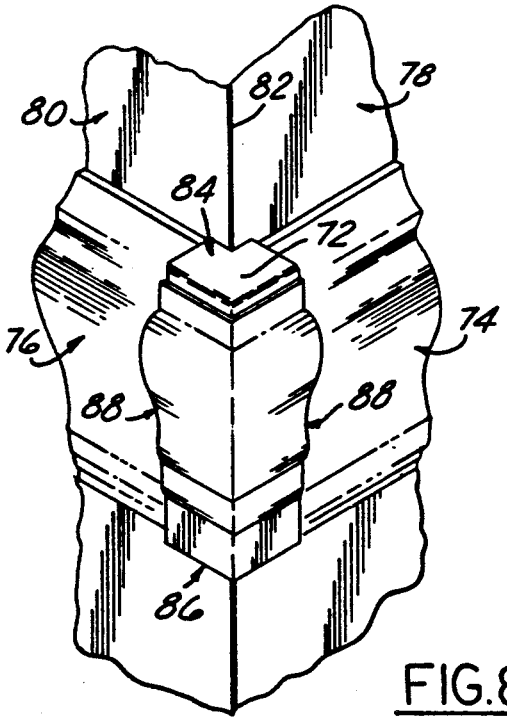
FIG. 8 is a perspective front view of an outside corner receptacle disposed over the adjacent ends of two lineal chair rail moldings.
Figure 9:
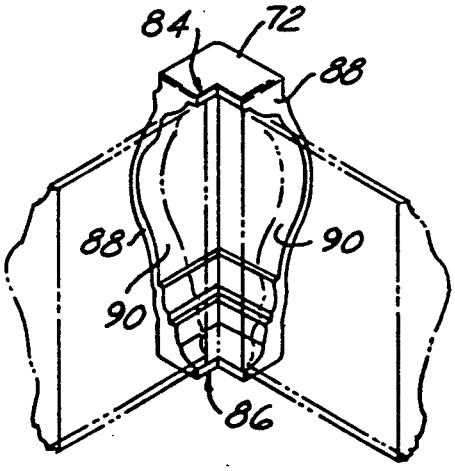
FIG. 9 is a perspective back view of the receptacle and moldings of FIG. 8 with the moldings shown in phantom lines.

FIGS. 8 and 9 illustrate an outside corner chair rail receptacle 72 disposed over the adjacent ends of chair rail moldings 74 and 76 and bearing against right angular sidewalls 78 and 80 forming an outside corner 82. The receptacle has right angular walls with top and bottom edges 84 and 86 which bear on the sidewalls and side edges 88 which project inwardly and have an end surface 90 which is complementary to and bears on the exterior surface of the moldings. Thus, in assembly, the receptacle 56 in cooperation with the sidewalls totally encloses and masks from view the adjacent ends of the moldings 74 and 76 to provide the exterior appearance of an accurate and precise corner joint, eliminate the need for cutting the moldings to a precise length and allow the moldings to have rough cut ends.

Figure 10:
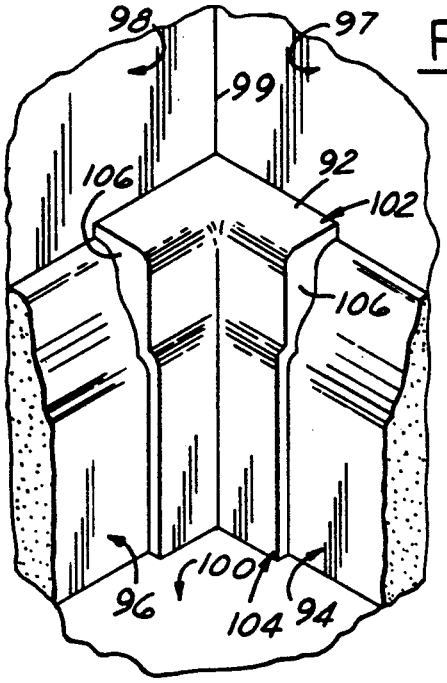
FIG. 10 is a perspective front view of an inside corner receptacle disposed over the adjacent ends of two lineal base moldings.
Figure 11:
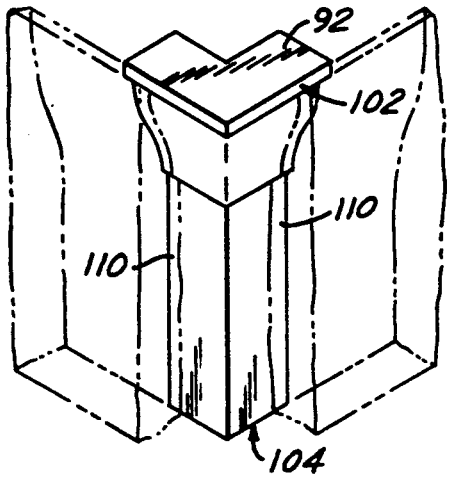
FIG. 11 is a perspective back view of the receptacle and moldings of FIG. 10 with the moldings shown in phantom lines.

As shown in FIGS. 10 and 11, the appearance of a precise joint is provided by an inside corner receptacle 92 disposed over the adjacent ends of base moldings 94 and 96 received on right angular sidewalls 97 and 98 forming an inside corner 99 and bearing on a floor 100. The receptacle has right angular walls with top and bottom edges 102 and 104 which bear on the sidewalls and the floor respectively and side edges 106 which project inwardly and have a surface 110 which is complementary to and bears on the exterior surface of the moldings. Thus, in assembly, the receptacle 95 in cooperation with the floor and sidewalls totally encloses and masks from view the adjacent ends of the base moldings 94 and 96 to provide the exterior appearance of an accurate and precise corner joint and eliminate the need for cutting to an accurate length and forming a miter joint on the ends of the moldings.

Figure 12:
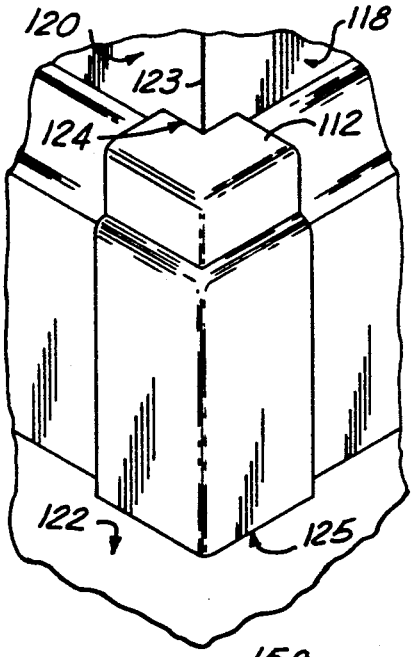
FIG. 12 is a perspective front view of an outside corner receptacle disposed over the adjacent ends of two lineal base moldings.
Figure 13:
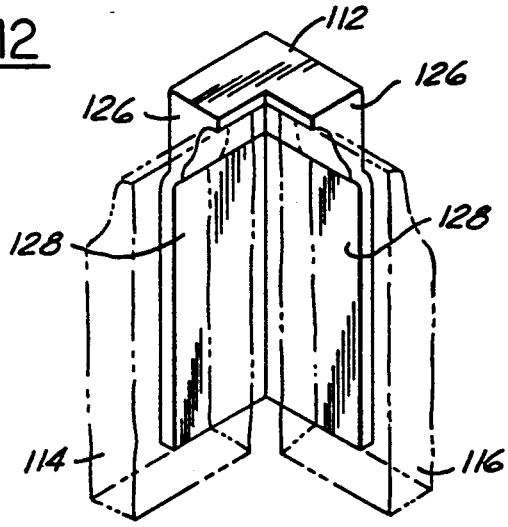
FIG. 13 is a perspective back view of the receptacle and moldings of FIG. 12 with the moldings shown in phantom lines.

FIGS. 12 and 13 show an outside corner receptacle 112 disposed over the adjacent ends of base moldings 114 and 116 secured to right angular walls 118 and 120 bearing on a floor 122 and forming an outside corner 123. This receptacle has right angular walls with top and bottom edges 124 and 125 which bear on the sidewalls and floor respectively and side edges 126 having a surface 128 which is complementary to and bears on the exterior surface of the moldings. In assembly, the receptacle provides the exterior appearance of an accurate and precise corner joint even though the moldings have rough cut ends, may not bear on one another, and may be cut to only approximately the correct length.

Figure 14:
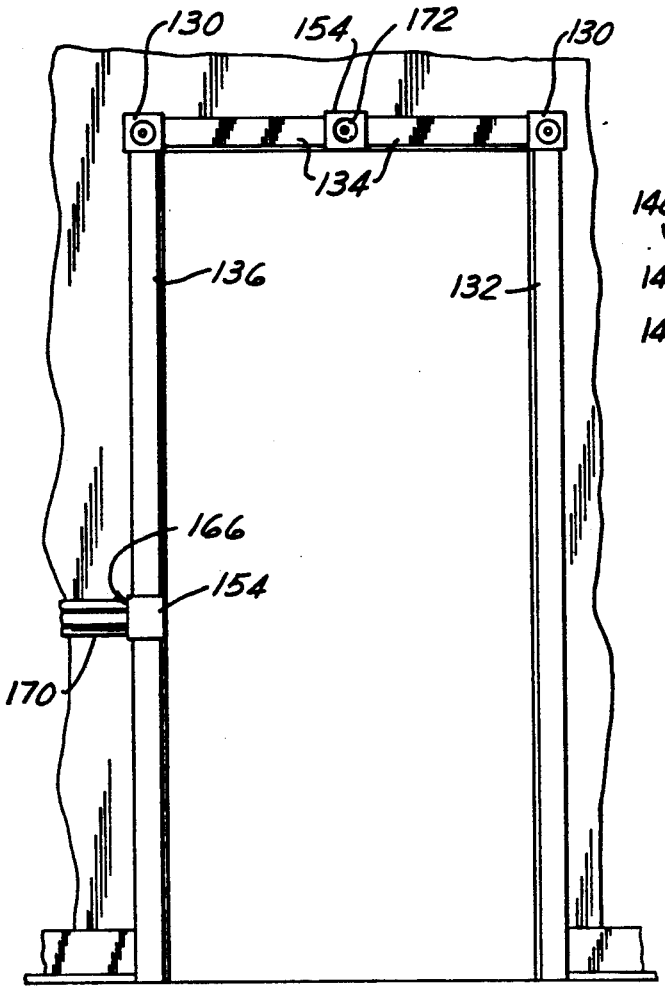
FIG. 14 is a front view of fluted casing moldings around a door opening with a pair of corner receptacles at the top corners, and a pair of lineal joints forming a keystone and a transitional block for a chair rail molding.
Figure 15:
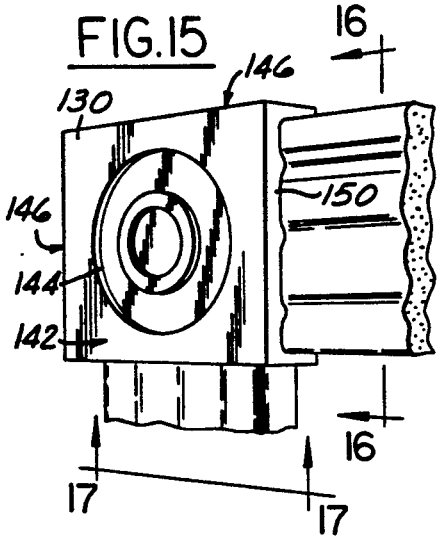
FIG. 15 is a perspective front view of a corner receptacle of FIG. 14 disposed over the adjacent ends of two lineal casing moldings.
Figure 16:
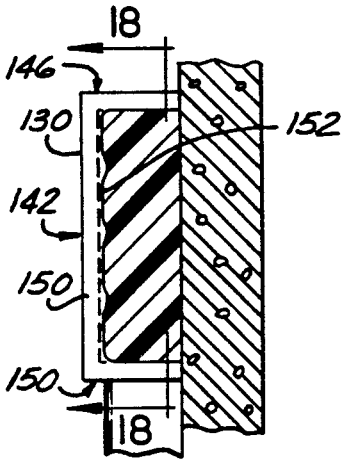
FIG. 16 is a vertical sectional view taken along the line 16—16 of FIG. 15.
Figure 18:
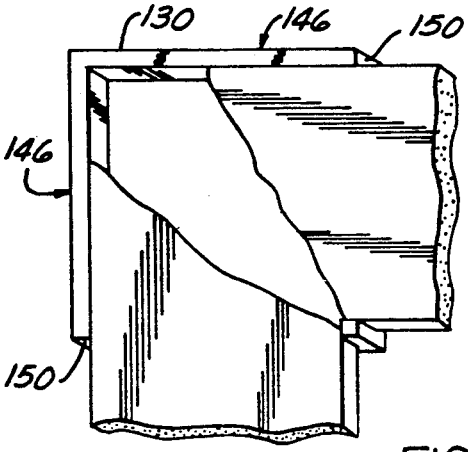
FIG. 18 is a perspective back view of a corner receptacle of FIG. 14 disposed over the adjacent ends of two lineal casing moldings.
Figure 17:
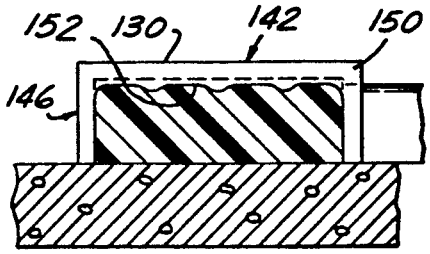
FIG. 17 is a horizontal sectional view taken along the line 17—17 of FIG. 15.

FIG. 14 shows a corner casing receptacle 130 disposed over casing moldings 132, 134, and 136 secured to a sidewall 138 around the periphery of a doorway 140. As shown in FIGS. 15–18, each receptacle 130 has a front face 142 with a decorative embossment 144 therein and two right angular side edges 146, each of which extends rearwardly and has a back face 148 which is complementary to and bears on the sidewall. Each receptacle also has two right angular side edges 150 each of which extends rearwardly and has a contoured end surface 152 which is complementary to and bears on the exterior decorative surface of the moldings. In assembly, the receptacle in cooperation with the sidewall, totally encloses and masks from view the adjacent ends of the moldings to provide the exterior appearance of a precise corner joint even though the moldings have rough cut ends, may not bear on one another, and may be cut to only approximately the correct length.

Figure 19:
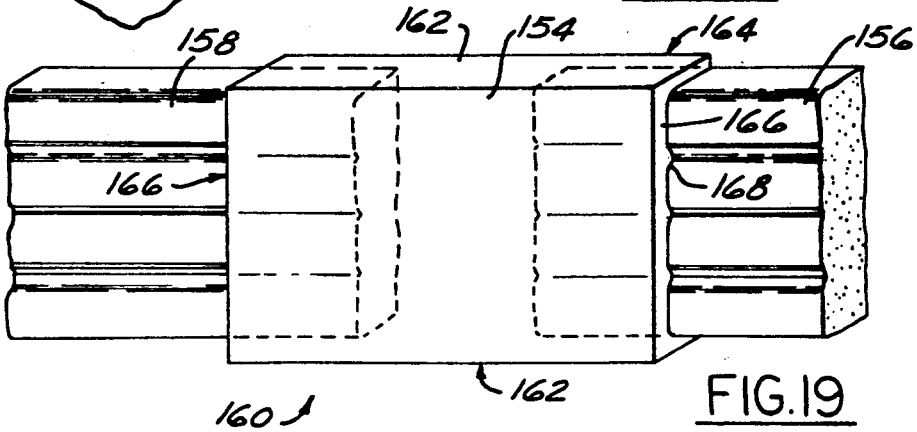
FIG. 19 is a perspective front view of a lineal receptacle disposed over the adjacent ends of casing moldings.

FIG. 19 illustrates a casing lineal receptacle 154 disposed over the adjacent ends of casing moldings 156, 158 secured to a common planar wall 160 to form a joint between the axially aligned moldings. This receptacle has a pair of parallel side edges 162 each of which extends rearwardly and has a planar back face 164 which is complementary to and bears on the sidewall. This receptacle also has two generally parallel side edges 166 each of which extends rearwardly and has a contoured end surface 168 which is complementary to and bears on the exterior decorative surface of the moldings. In assembly, this receptacle in cooperation with the sidewall totally encloses and masks from view the adjacent ends of the moldings to provide the exterior appearance of a precise lineal joint even though the moldings have rough cut ends, may be spaced from one another and cut to only approximately the correct length.

As shown in FIG. 14, this receptacle 154 can also be disposed over a single casing molding 136 to provide a transition for an abutting right angular end of a chair rail molding 170 secured to the sidewall 138. The end of the chair rail molding bears on one of the side edges 166 of the receptacle. As shown in FIG. 14, a receptacle 154 can also be disposed over the single lineal molding 134 and centered between the corner receptacles 130 to provide the appearance of a keystone for the doorway. If desired, the receptacle 154 can have a decorative embossment 172 in its outer face.

All of the embodiments of this invention provide the appearance of a precise and finished joint between adjacent moldings without a mitered or other precision joining of the moldings and even though the moldings are not cut to a precise length and their adjacent ends may be rough cut and spaced apart. All of the receptacles in cooperation with an underlying wall telescopically receive the adjacent ends of adjacent moldings so that in assembly the ends are completely hidden and masked from view from the exterior of the receptacle and provide the appearance of a highly decorative and finished joint. The receptacles for right angular walls have decorative right angular outer surfaces which preferably have a contour generally similar to that of their associated moldings and provide the appearance of a mitered joint between the decorative surfaces. All of the receptacles may be molded of a plastic resin material, are of economical manufacture and provide a molding system of simplified design which can be readily and easily assembled by relatively unskilled persons utilizing a few simple hand tools.

I claim:

1. A receptacle providing the exterior appearance of a finished joint of two adjacent lineal moldings received on at least one wall of a room which comprises: a body having an opaque front face overlying adjacent ends of adjacent lineal moldings, at least two opaque side faces of which extends generally transverse to an adjacent portion of said front face and extends across the entire face width of an underlying lineal molding, each of said two side faces having an edge contoured for complimentarily mating engagement with the outer surface of an underlying lineal molding, said front face being generally planar, said two side faces each having a contoured edge being generally parallel to each other, and each said contoured edge in cooperation with said body and an underlying portion of a wall providing a recess telescopically receiving a portion of a lineal molding with its adjacent end underlying said body.

2. The receptacle of claim 1 wherein said front face is generally planar and has an embossment thereon.

3. The receptacle of claim 1 wherein said body also comprises a second pair of side faces extending generally parallel to each other and generally transversely to and between said two side faces and are constructed and arranged so that in assembly the adjacent ends of moldings lie between them, and said second pair of side faces are constructed and arranged to each have an edge which in assembly bears on the surface on which the lineal moldings are received.

4. The receptacle of claim 1 wherein said two side faces having a contoured edge are spaced apart sufficiently and constructed and arranged so that in assembly the adjacent ends of adjacent moldings telescopically received in said recesses may be at least somewhat spaced apart so that such adjacent ends do not abut and still underlie said body of the receptacle to provide the exterior appearance of a finished joint even if such adjacent ends of such moldings are spaced apart and do not abut.

5. A receptacle providing the exterior appearance of a finished joint of two adjacent lineal moldings received on at least one wall of a room which comprises: a body having an opaque front face overlying adjacent ends of adjacent lineal moldings, at least two opaque side faces each of which extends generally transverse to an adjacent portion of said front face and extends across the entire face width of an underlying lineal molding, each of said two side faces having an edge contoured for complimentarily mating engagement with the outer surface of an underlying lineal molding, said front face being generally planar, said two side faces each having a contoured edge being at generally right angles to each other, and each said contoured edge in cooperation with said body and an underlying portion of a wall providing a recess telescopically receiving a portion of a lineal molding with its adjacent end underlying said body.

6. A receptacle providing the exterior appearance of a finished joint of two adjacent lineal moldings received on at least one wall of a room which comprises: a body having an opaque front face overlying adjacent ends of adjacent lineal moldings, said front face being generally planar, at least two opaque side faces each of which extends generally transverse to an adjacent portion of said front face and extends across the entire face width of an underlying lineal molding, each of said two side faces being at generally a right angle to the other and having an edge contoured for complimentarily mating engagement with the outer surface of an underlying lineal molding, a second pair of side faces extending at generally right angles to each other and each extending generally parallel to one of said two side faces having a contoured edge and being constructed and arranged so that in assembly each extends generally parallel to the axis of one of the lineal moldings and generally transverse to the axis of the other of the lineal moldings received in the receptacle, said second pair of faces are constructed and arranged to each have an edge which is assembly bears on the surface on which the lineal moldings are received, and each said contoured edge in cooperation with said body and an underlying portion of a wall providing a recess telescopically receiving a portion of a lineal molding with its adjacent end underlying said body.

7. A receptacle for crown moldings providing the exterior appearance of a finished joint of two adjacent lineal crown moldings received on walls at generally a right angle to each other which comprises: a body having an opaque front face overlying adjacent ends of adjacent lineal crown moldings, at least two opaque side faces each of which extends generally transverse to an adjacent portion of said front face and extends across the entire face width of an underlying lineal crown molding, each of said two side faces having an edge contoured for complimentarily mating engagement with the outer surface of an underlying lineal crown molding said contour of said edge of said side face being different than the contour of the exterior of said front face, said front face having first and second wall portions at substantially a right angle to each other which are joined together with the exterior appearance of a mitered joint, in assembly each of said first and second wall portions extending across the transverse width of an underlying crown molding and having a first edge terminating substantially contemporaneously with one side of its associated underlying molding, and second edge terminating adjacent the other side of its associated molding and having an inwardly projecting portion overlapping such other side of such molding and terminating substantially contemporaneously with a back mounting surface of such other side for such molding, and each said contoured edge in cooperation with said body and an underlying portion of a wall providing a recess telescopically receiving a portion of a lineal crown molding with its adjacent end underlying said body.

8. A receptacle for base moldings providing the exterior appearance of a finished joint of two adjacent lineal base moldings received on walls at generally a right angle to each other which comprises: a body having an opaque front face overlying adjacent ends of adjacent lineal base moldings, at least two opaque side faces each of which extends generally transverse to an adjacent portion of said front face and extends across the entire face width of an underlying lineal base molding, each of said two side faces having an edge contoured for complimentarily mating engagement with the outer surface of an underlying lineal base molding, said contour of said edge of said side face being different than the contour of the exterior of said front face said front face having first and second wall portions at substantially a right angle to each other which are joined together with the exterior appearance of a mitered joint, in assembly each of said first and second wall portions extending across the transverse width of an underlying base molding and having a first edge terminating substantially contemporaneously with one side of its associated underlying molding, and second edge terminating adjacent the other side of its associated molding and having an inwardly projecting portion overlapping such other side of such molding and terminating substantially contemporaneously with a back mounting surface of such other side for such molding, and each said contoured edge in cooperation with said body and an underlying portion of a wall providing a recess telescopically receiving a portion of a lineal base molding with its adjacent end underlying said body.

9. A receptacle for chair rail moldings providing the exterior appearance of a finished joint of two adjacent lineal chair rail moldings received on walls at generally a right angle to each other which comprises: a body having an opaque front face overlying adjacent ends of adjacent lineal chair rail moldings, at least two opaque side faces each of which extends generally transverse to an adjacent portion of said front face and extends across the entire face width of an underlying lineal chair rail molding, each of said two side faces having an edge contoured for complimentarily mating engagement with the outer surface of an underlying lineal base molding said contour of said edge of said side face being different than the contour of the exterior of siad front face, said front face having first and second wall portions at substantially a right angle to each other which are joined together with the exterior appearance of a mitered joint, in assembly each of said first and second wall portions extending across the transverse width of an underlying associated chair rail molding and having a first portion projecting inwardly and overlapping one side edge of its associated chair rail molding and a second portion projecting inwardly and overlapping the other side edge of its associated chair rail molding, and both said first and second inwardly projecting portions termianting substantially contemporaneously with a back mounting surface of their associated chair rail molding, and each said contoured edge in cooperation with said body and an underlying portion of a wall providing a recess telescopically receiving a portion of a chair rail lineal molding with its adjacent end underlying said body.

10. A receptacle for casing moldings providing the exterior appearance of a finished joint of two adjacent lineal casing moldings received on a wall which comprises: a body having an opaque front face overlying adjacent ends of adjacent lineal casing moldings, at least two opaque side faces each of which extends generally transverse to an adjacent portion of said front face and extends across the entire face width of an underlying lineal base molding, each of said two side faces having an edge contoured for complimentarily mating engagement with the outer surface of an underlying lineal casing molding, said front face has first and second wall portions at substantially a right angle to each other which are joined together with the exterior appearance of a mitered joint, in assembly each of said first and second wall portions extending across the transverse width of an underlying associated casing molding and having a first portion projecting inwardly and overlapping one side edge of its associated casing molding and a second portion projecting inwardly and overlapping the other side edge of its associated casing molding, both said first and second inwardly projecting portions terminating substantially contemporaneously with a back mounting surface of their associated casing molding, and each said contoured edge in cooperation with said body and an underlying portion of a wall providing a recess telescopically receiving a portion of a lineal casing molding with its adjacent end underlying said body.

11. A receptacle providing the exterior appearance of a finished joint of two adjacent lineal moldings received on the same generally planar wall which comprises: a body having an opaque and generally planar front face overlying adjacent ends of adjacent lineal moldings, two opaque side faces each of which extends generally transverse to an adjacent portion of said front face and extends across the entire face width of an underlying lineal molding, each of said two side faces being parallel to the other and having an edge contoured for complimentarily mating engagement with the outer surface of an underlying lineal molding, a pair of side faces extending generally parallel to each other and generally transversely to and between said two side faces, said pair of side faces being constructed and arranged so that in assembly the adjacent ends of moldings lie between then, said pair of side faces each having an edge which in assembly bears on the same generally planar wall on which the lineal moldings are received, and each said contoured edge in cooperation with said body and an underlying portion of a wall providing a recess telescopically receiving a portion of a lineal molding with its adjacent end underlying said body.

12. A receptacle providing the exterior appearance of a finished joint of two adjacent lineal moldings received on the same generally planar wall which comprises: a body having an opaque and generally planar front face overlying adjacent ends of adjacent lineal moldings, two opaque side faces each of which extends generally transverse to an adjacent portion of said front face and extends across the entire face width of an underlying lineal molding said contour of said edge of said side face being different than the contour of the exterior of said front face, each of said two side faces being generally at a right angle to the other and having an edge contoured for complimentarily mating engagement with the outer surface of an underlying lineal molding, a pair of side faces extending generally right angles to each other and each extending generally parallel to one of said two side faces having a contoured edge, said pair of side faces being constructed and arranged so that in assembly each one extends generally parallel to the axis of one of the lineal moldings and generally transverse to the axis of the other of the lineal moldings received in the receptacle, and said pair of side faces each having an edge which in assembly bears on the same generally planar wall on which the lineal moldings are received, and each said contoured edge in cooperation with said body and an underlying portion of a wall providing a recess telescopically receiving a portion of a lineal molding with its adjacent end underlying said body.

* * * * *